US006543993B2

(12) United States Patent
Burdgick et al.

(10) Patent No.: US 6,543,993 B2
(45) Date of Patent: Apr. 8, 2003

(54) APPARATUS AND METHODS FOR LOCALIZED COOLING OF GAS TURBINE NOZZLE WALLS

(75) Inventors: Steven Sebastian Burdgick, Schenectady, NY (US); Gary Michael Itzel, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 76 days.

(21) Appl. No.: 09/749,616

(22) Filed: Dec. 28, 2000

(65) Prior Publication Data

US 2002/0085910 A1 Jul. 4, 2002

(51) Int. Cl.[7] ..... F01D 9/06
(52) U.S. Cl. ..... 415/116; 415/114; 416/96 R
(58) Field of Search ..... 415/114, 115, 415/116; 416/96 R, 96 A, 97 R

(56) References Cited

U.S. PATENT DOCUMENTS

| | | | | |
|---|---|---|---|---|
| 3,628,880 A | * | 12/1971 | Smuland et al. | 415/115 |
| 4,798,515 A | * | 1/1989 | Hsia et al. | 415/115 |
| 4,992,026 A | * | 2/1991 | Ohtomo et al. | 416/97 R |
| 5,743,708 A | | 4/1998 | Cunha et al. | |
| 6,325,593 B1 | * | 12/2001 | Darkins, Jr. et al. | 415/115 |

FOREIGN PATENT DOCUMENTS

| | | | | |
|---|---|---|---|---|
| CA | 586665 A | * | 11/1959 | 415/116 |
| JP | 61-149503 A | * | 7/1986 | 416/97 R |

OTHER PUBLICATIONS

"39$^{th}$ GE Turbine State–of–the–Art Technology Seminar", Tab 1,""F" Technology—the First Half Million Operating Hours", H.E. Miller.

"39$^{th}$ GE Turbine State–of–the–Art Technology Seminar", Tab 2, "GE Heavy–Duty Gas Turbine Performance Characteristics", F. J. Brooks.

"39$^{th}$ GE Turbine State–of–the–Art Technology Seminar", Tab 3, "9EC 50Hz 170–MW Class Gas Turbine", A.S. Arrao.

"39$^{th}$ GE Turbine State–of–the–Art Technology Seminar", Tab 4, "MWS6001FA—An Advanced–Technology 70–MW Class 50/60 Hz Gas Turbine", Ramachandran et al.

"39$^{th}$ GE Turbine State–of–the–Art Technology Seminar", Tab 5, "Turbomachinery Technology Advances at Nuovo Pignone", Benvenuti et al.

"39$^{th}$ GE Turbine State–of–the–Art Technology Seminar", Tab 6, "GE Aeroderivative Gas Turbines—Design and Operating Features", M.W. Horner.

(List continued on next page.)

*Primary Examiner*—Christopher Verdier
(74) *Attorney, Agent, or Firm*—Nixon & Vanderhye

(57) ABSTRACT

In a closed-circuit steam-cooling system for the first-stage nozzle of a gas turbine, each vane has a plurality of cavities with inserts. In the second cavity, a main insert receives cooling steam from an inner plenum for impingement-cooling of the side walls of the vane, the spent cooling steam exhausting between the main insert and the cavity walls into a steam outlet. To steam-cool a localized surface area of the vane adjacent the outer band, a secondary insert receives steam under inlet conditions from a first chamber of the outer band for impingement-cooling the localized surface area. The spent impingement-cooling steam from the secondary insert combines with the spent cooling steam from the main insert for flow to the outlet. Consequently, low-cycle fatigue is improved in the localized area by the impingement-cooling afforded by the secondary insert because of the cooler steam supplied, as well as the increased pressure drop driving the steam through the impingement openings of the secondary insert.

28 Claims, 6 Drawing Sheets

OTHER PUBLICATIONS

"39th GE Turbine State–of–the–Art Technology Seminar", Tab 7, "Advance Gas Turbine Materials and Coatings", P.W. Schilke.
"39th GE Turbine State–of–the–Art Technology Seminar", Tab 8, "Dry Low $NO_x$ Combustion Systems for GE Heavy–Duty Turbines", L. B. Davis.
"39th GE Turbine State–of–the–Art Technology Seminar", Tab 9, "GE Gas Turbine Combustion Flexibility", M. A. Davi.
"39th GE Turbine State–of–the–Art Technology Seminar", Tab 10, "Gas Fuel Clean–Up System Design Considerations for GE Heavy–Duty Gas Turbines", C. Wilkes.
"39th GE Turbine State–of–the–Art Technology Seminar", Tab 11, "Integrated Control Systems, for Advanced Combined Cycles", Chu et al.
"39th GE Turbine State–of–the–Art Technology Seminar", Tab 12, "Power Systems for the 21st Century "H" Gas Turbine Combined Cycles", Paul et al.
"39th GE Turbine State–of–the–Art Technology Seminar", Tab 13, "Clean Coal and Heavy Oil Technologies for Gas Turbines", D. M. Todd.
"39th GE Turbine State–of–the–Art Technology Seminar", Tab 14, "Gas Turbine Conversions, Modifications and Uprates Technology", Stuck et al.
"39th GE Turbine State–of–the–Art Technology Seminar", Tab 15, Performance and Reliability Improvements for Heavy–Duty Gas Turbines, J. R. Johnston.
"39th GE Turbine State–of–the–Art Technology Seminar", Tab 16, "Gas Turbine Repair Technology", Crimi et al.
"39th GE Turbine State–of–the–Art Technology Seminar", Tab 17, "Heavy Duty Turbine Operating & Maintenance Considerations", R. F. Hoeft.
"39th GE Turbine State–of–the–Art Technology Seminar", Tab 18, "Gas Turbine Performance Monitoring and Testing", Schmitt et al.
"39th GE Turbine State–of–the–Art Technology Seminar", Tab 19, "Monitoring Service Delivery System and Diagnostics", Madej et al.
"39th GE Turbine State–of–the–Art Technology Seminar", Tab 20, "Steam Turbines for Large Power Applications", Reinker et al.
"39th GE Turbine State–of–the–Art Technology Seminar", Tab 21, "Steam Turbines for Ultrasupercritical Power Plants", Retzlaff et al.
"39th GE Turbine State–of–the–Art Technology Seminar", Tab 22, "Steam Turbine Sustained Efficiency", P. Schofield.
"39th GE Turbine State–of–the–Art Technology Seminar", Tab 23, "Recent Advances in Steam Turbines for Industrial and Cogeneration Applications", Leger et al.
"39th GE Turbine State–of–the–Art Technology Seminar", Tab 24, "Mechanical Drive Steam Turbines", D. R. Leger.
"39th GE Turbine State–of–the–Art Technology Seminar", Tab 25, "Steam Turbines for STAG™ Combined–Cycle Power Systems", M. Boss.
"39th GE Turbine State–of–the–Art Technology Seminar", Tab 26, "Cogeneration Application Considerations", Fisk et al.
"39th GE Turbine State–of–the–Art Technology Seminar", Tab 27, "Performance and Economic Considerations of Repowering Steam Power Plants", Stoll et al.
"39th GE Turbine State–of–the–Art Technology Seminar", Tab 28, "High–Power–Density™ Steam Turbine Design Evolution", J. H. Moore.
"39th GE Turbine State–of–the–Art Technology Seminar", Tab 29, "Advances in Steam Path Technologies", Cofer, IV, et al.
"39th GE Turbine State–of–the–Art Technology Seminar", Tab 30, "Upgradable Opportunities for Steam Turbines", D. R. Dreier, Jr.
"39th GE Turbine State–of–the–Art Technology Seminar", Tab 31, "Uprate Options for Industrial Turbines", R. C. Beck.
"39th GE Turbine State–of–the–Art Technology Seminar", Tab 32, "Thermal Performance Evaluation and Assessment of Steam Turbine Units", P. Albert.
"39th GE Turbine State–of–the–Art Technology Seminar", Tab 33, "Advances in Welding Repair Technology" J. F. Nolan.
"39th GE Turbine State–of–the–Art Technology Seminar", Tab 34, "Operation and Maintenance Strategies to Enhance Plant Profitability", MacGillivray et al.
"39th GE Turbine State–of–the–Art Technology Seminar", Tab 35, "Generator Insitu Inspections", D. Stanton.
"39th GE Turbine State–of–the–Art Technology Seminar", Tab 36, "Generator Upgrade and Rewind", Halpern et al., Aug. 1996.
"39th GE Turbine State–of–the–Art Technology Seminar", Tab 37, "GE Combined Cycle Product Line and Performance", Chase, et al.
"39th GE Turbine State–of–the–Art Technology Seminar", Tab 38, "GE Combined Cycle Experience", Maslak et al.
"39th GE Turbine State–of–the–Art Technology Seminar", Tab 39, "Single–Shaft Combined Cycle Power Generation Systems", Tomlinson et al.
"Advanced Turbine System Program—Conceptual Design and Product Development", Annual Report, Sep. 1, 1994–Aug. 31, 1995
"Advanced Turbine Systems (ATS Program) Conceptual Design and Product Development", Final Technical Progress Report, Vol. 2–Industrial Machine, Mar. 31, 1997, Morgantown, WV.
"Advanced Turbine Systems (ATS Program) Conceptual Design and Product Development", Final Technical Progress Report, Aug. 31, 1996, Morgantown, WV.
"Advanced Turbine Systems (ATS) Program, Phase 2, Conceptual Design and Product Development", Yearly Technical Progress Report, Reporting Period: Aug. 25, 1993–Aug. 31, 1994.
"Advanced Turbine Systems" Annual Program Review, Preprints, Nov. 2–4, 1998, Washington, D.C. U.S. Department of Energy, Office of Industrial Technologies Federal Energy Technology Center.
"ATS Conference" Oct. 28, 1999, Slide Presentation.
"Baglan Bay Launch Site", various articles relating to Baglan Energy Park.
"Baglan Energy Park", Brochure.
"Commercialization", Del Williamson, Present, Global Sales, May 8, 1998.
"Environmental, Health and Safety Assessment: ATS 7H Program (Phase 3R) Test Activities at the GE Power Systems Gas Turbine Manufacturing Facility, Greenville, SC", Document #1753, Feb. 1998, Publication Date: Nov. 17, 1998, Report Numbers DE–FC21–95MC31176–11.
"Exhibit panels used at 1995 product introduction at PowerGen Europe".

"Extensive Testing Program Validates High Efficiency, reliability of GE's Advanced "H" Gas Turbine Technology", Press Information, Press Release, 96–NR14, Jun. 26, 1996, H Technology Tests pp. 1–4.
"Extensive Testing Program Validates High Efficiency, Reliability of GE's Advanced "H" Gas Turbine Technology", GE Introduces Advanced Gas Turbine Technology Platform: First to Reach 60% Combined–Cycle Power Plant Efficiency, Press Information, Press Release, Power–Gen Europe '95, 95–NRR15, Advanced Technology Introduction/pp.1–6.
"Gas, Steam Turbine Work as Single Unit in GE's Advanced H Technology Combined–Cycle System", Press Information, Press Release, 95–NR18, May 16, 1995, Advanced Technology Introduction/pp. 1–3.
"GE Breaks 60% Net Efficiency Barrier" paper, 4 pages.
"GE Businesses Share Technologies and Experts to Develop State–Of–The–Art Products", Press Information, Press Release 95–NR10, May 16, 1995, GE Technology Transfer/pp. 1–3.
"General Electric ATS Program Technical Review, Phase 2 Activities", T. Chance et al., pp. 1–4.
"General Electric's DOE/ATS H Gas Turbine Development" Advanced Turbine Systems Annual Review Meeting, Nov. 7–8, 1996, Washington, D.C., Publication Release.
"H Technology Commercialization", 1998 MarComm Activity Recommendation, Mar., 1998.
"H Technology", Jon Ebacher, VP, Power Gen Technology, May 8, 1998.
"H Testing Process", Jon Ebacher, VP, Power Gen Technology, May 8, 1998.
"Heavy–Duty & Aeroderivative Products" Gas Turbines, Brochure, 1998.
"MS7001H/MS9001H Gas Turbine, gepower.com website for PowerGen Europe" Jun. 1–3 going public Jun. 15, (1995).
"New Steam Cooling System is a Key to 60% Efficiency for GE "H" Technology Combined–Cycle Systems", Press Information, Press Release, 95–NRR16, May 16, 1995, H Technology/pp. 1–3.
"Overview of GE's H Gas Turbine Combined Cycle", Jul. 1, 1995 to Dec. 31, 1997.
"Power Systems for the 21$^{st}$Century —"H" Gas Turbine Combined Cycles", Thomas C. Paul et al., Report.
"Power–Gen '96 Europe", Conference Programme, Budapest, Hungary, Jun. 26–28, 1996.
"Power–Gen International", 1998 Show Guide, Dec. 9–11, 1998, Orange County Convention Center, Orlando, Florida.
"Press Coverage following 1995 product announcement"; various newspaper clippings relating to improved generator.
"Proceedings of the Advanced Turbine Systems Annual Program Review Meeting", vol. I, "Industrial Advanced Turbine Systems Program Overview", D.W. Esbeck, p. 3.
"Proceedings of the Advanced Turbine Systems Annual Program Review Meeting", vol. I, "H Gas Turbine Combined Cycle", J. Corman, p. 14.
"Proceedings of the Advanced Turbine Systems Annual Program Review Meeting", vol. I, "Overview of Westinghouse's Advanced Turbine Systems Program", Bannister et al., p. 22.
"Proceedings of the Advanced Turbine Systems Annual Program Review Meeting", vol. I, "Allison Engine ATS Program Technical Review", D. Mukavetz, p. 31.
"Proceedings of the Advanced Turbine Systems Annual Program Review Meeting", vol. I, "Advanced Turbine Systems, Program Industrial System Concept Development", S. Gates, p. 43.
"Proceedings of the Advanced Turbine Systems Annual Program Review Meeting", vol. I, "Advanced Turbine System Program Phase 2 Cycle Selection", Latcovich, Jr., p. 64.
"Proceedings of the Advanced Turbine Systems Annual Program Review Meeting", vol. I, "General Electric ATS Program Technical Review Phase 2 Activities", Chance et al., p. 70.
"Proceedings of the Advanced Turbine Systems Annual Program Review Meeting", vol. I, "Technical Review of Westinghouse's Advanced Turbine Systems Program", Diakunchak et al., p. 75.
"Proceedings of the Advanced Turbine Systems Annual Program Review Meeting", vol. I, "Advanced Combustion Turbines and Cycles: An EPRI Perspective", Touchton et al., p. 87.
"Proceedings of the Advanced Turbine Systems Annual Program Review Meeting", vol. I, "Advanced Turbine Systems Annual Program Review", William E. Koop, pp. 89–92, Oct., 1995.
"Proceedings of the Advanced Turbine Systems Annual Program Review Meeting", vol. I, "The AGTSR Consortium: An Update", Fant et al., p. 93.
"Proceedings of the Advanced Turbine Systems Annual Program Review Meeting", vol. I, "Overview of Allison/AGTSR Interactions", Sy A. Ali, p. 103.
"Proceedings of the Advanced Turbine Systems Annual Program Review Meeting", vol. I, "Design Factors for Stable Lean Premix Combustion", Richards et al., p. 107.
"Proceedings of the Advanced Turbine Systems Annual Program Review Meeting", vol. I, "Ceramic Stationary as Turbine", M. van Roode, p. 114.
"Proceedings of the Advanced Turbine Systems Annual Program Review Meeting", vol. I, "DOE/Allison Ceramic Vane Effort", Wenglarz et al., p. 148.
"Proceedings of the Advanced Turbine Systems Annual Program Review Meeting", vol. I, "Materials/Manufacturing Element of the Advanced Turbine Systems Program", Karnitz et al., p. 152.
"Proceedings of the Advanced Turbine Systems Annual Program Review Meeting", vol. I, "Land–Based Turbine Casting Initiative", Mueller et al., p. 161.
"Proceedings of the Advanced Turbine Systems Annual Program Review Meeting", vol. I, "Pratt & Whitney Thermal Barrier Coatings", Bornstein et al., p. 182.
"Proceedings of the Advanced Turbine Systems Annual Program Review Meeting", vol. I, "Westinhouse Thermal Barrier Coatings", Goedjen et al., p. 194.
"Proceedings of the Advanced Turbine Systems Annual Program Review Meeting", vol. I, "High Performance Steam Development", Duffy et al., p. 200.
"Proceedings of the Advanced Turbine Systems Annual Program Review Meeting", vol. II, "Lean Premixed Combustion Stabilized by Radiation Feedback and heterogeneous Catalysis", Dibble et al., p. 221.
"Proceedings of the Advanced Turbine Systems Annual Program Review Meeting", vol. II, Rayleigh/Raman/LIF Measurements in a Turbulent Lean Premixed Combustor, Nandula et al. p. 233.

"Proceedings of the Advanced Turbine Systems Annual Program Review Meeting", vol. II, "Lean Premixed Flames for Low $No_x$ Combustors", Sojka et al., p. 249.

"Proceedings of the Advanced Turbine Systems Annual Program Review Meeting", vol. II, "Functionally Gradient Materials for Thermal Barrier Coatings in Advanced Gas Turbine Systems", Banovic et al., p. 276.

"Proceedings of the Advanced Turbine Systems Annual Program Review Meeting", vol. II, "Advanced Turbine Cooling, Heat Transfer, and Aerodynamic Studies", Han et al., p. 281.

"Proceedings of the Advanced Turbine Systems Annual Program Review Meeting", vol. II, "Life Prediction of Advanced Materials for Gas Turbine Application", Zamrik et al., p. 310.

"Proceedings of the Advanced Turbine Systems Annual Program Review Meeting", vol. II, "Advanced Combustion Technologies for Gas Turbine Power Plants", Vandsburger et al., p. 328.

"Proceedings of the Advanced Turbine Systems Annual Program Review Meeting", vol. II, "Combustion Modeling in Advanced Gas Turbine Systems", Smoot et al., p. 353.

"Proceedings of the Advanced Turbine Systems Annual Program Review Meeting", vol. II, "Heat Transfer in a Two–Pass Internally Ribbed Turbine Blade Coolant Channel with Cylindrical Vortex Generators", Hibbs et al. p. 371.

"Proceedings of the Advanced Turbine Systems Annual Program Review Meeting", vol. II, "Rotational Effects on Turbine Blade Cooling", Govatzidakia et al., p. 391.

"Proceedings of the Advanced Turbine Systems Annual Program Review Meeting", vol. II, "Manifold Methods for Methane Combustion", Yang et al., p. 393.

"Proceedings of the Advanced Turbine Systems Annual Program Review Meeting", vol. II, "Advanced Multistage Turbine Blade Aerodynamics, Performance, Cooling, and Heat Transfer", Fleeter et al., p. 410.

"Proceedings of the Advanced Turbine Systems Annual Program Review Meeting, vol. II", The Role of Reactant Unmixedness, Strain Rate, and Length Scale on Premixed Combustor Performance, Samuelsen et al., p. 415.

"Proceedings of the Advanced Turbine Systems Annual Program Review Meeting", vol. II, "Experimental and Computational Studies of Film Cooling With Compound Angle Injection", Goldstein et al., p. 423.

"Proceedings of the Advanced Turbine Systems Annual Program Review Meeting", vol. II, "Compatibility of Gas Turbine Materials with Stem Cooling", Desai et al., p. 452.

"Proceedings of the Advanced Turbine Systems Annual Program Review Meeting", vol. II, "Use of a Laser–Induced Fluorescence Thermal Imaging System for Film Cooling Heat Transfer Measurement"M. K. Chyu, p. 465.

"Proceedings of the Advanced Turbine Systems Annual Program Review Meeting", vol. II, Effects of Geometry on Slot–Jet Film Cooling Performance, Hyams et al., p. 474.

"Proceedings of the Advanced Turbine Systems Annual Program Review Meeting", vol. II, "Steam as Turbine Blade Coolant: Experimental Data Generation", Wilmsen et al., p. 497.

"Proceedings of the Advanced Turbine Systems Annual Program Review Meeting", vol. II, "Combustion Chemical Vapor Deposited Coatings for Thermal Barrier Coating Systems", Hampikian et al., p. 506.

"Proceedings of the Advanced Turbine Systems Annual Program Review Meeting", vol. II, "Premixed Burner Experiments: Geometry, Mixing, and Flame Structure Issues", Gupta et al., p. 516.

"Proceedings of the Advanced Turbine Systems Annual Program Review Meeting", vol. II, "Intercooler Flow Path for Gas Turbines: CFD Design and Experiments", Agrawal et al., p. 529.

"Proceedings of the Advanced Turbine Systems Annual Program Review Meeting", vol. II, "Bond Strength and Stress Measurements in Thermal Barrier Coatings", Gell et al., p. 539.

"Proceedings of the Advanced Turbine Systems Annual Program Review Meeting", vol. II, "Active Control of Combustion Instabilities in Low $NO_x$ Gas Turbines", Zinn et al., p. 550.

"Proceedings of the Advanced Turbine Systems Annual Program Review Meeting", vol. II, "Combustion Instability Modeling and Analysis", Santoro et al., p. 552.

"Proceedings of the Advanced Turbine Systems Annual Program Review Meeting", vol. II, "Flow and Heat Transfer in Gas Turbine Disk Cavities Subject to Nonuniform External Pressure Field", Roy et al., p. 560.

"Proceedings of the Advanced Turbine Systems Annual Program Review Meeting", vol. II, "Heat Pipe Turbine Vane Cooling", Langston et al., p. 566.

"Proceedings of the Advanced Turbine Systems Annual Program Review Meeting", vol. II, "Improved Modeling Techniques for Turbomachinery Flow Fields", Lakshminarayana et al., p. 573.

"Proceedings of the Advanced Turbine Systems Annual Program Review Meeting", vol. II, "Advanced 3D Inverse Method for Designing Turbomachine Blades", T. Dang, p. 582.

"Proceedings of the Advanced Turbine Systems Annual Program Review Meeting", "ATS and the Industries of the Future", Denise Swink, p. 1.

"Proceedings of the Advanced Turbine Systems Annual Program Review Meeting", "Gas Turbine Association Agenda", William H. Day, p. 3.

"Proceedings of the Advanced Turbine Systems Annual Program Review Meeting", "Power Needs in the Chemical Industry", Keith Davidson, p. 17.

"Proceedings of the Advanced Turbine Systems Annual Program Review Meeting", "Advanced Turbine Systems Program Overview", David Esbeck, p. 27.

"Proceedings of the Advanced Turbine Systems Annual Program Review Meeting", "Westinghouse's Advanced Turbine Systems Program", Gerard McQuiggan, p. 35.

"Proceedings of the Advanced Turbine Systems Annual Program Review Meeting", "Overview of GE's H Gas Turbine Combined Cycle", Cook et al., p. 49.

"Proceedings of the Advanced Turbine Systems Annual Program Review Meeting", "Allison Advanced Simple Cycle Gas Turbine System", William D. Weisbrod, p. 73.

"Proceedings of the Advanced Turbine Systems Annual Program Review Meeting", "The AGTSR Industry–University Consortium", Lawrence P. Golan, p. 95.

"Proceedings of the Advanced Turbine Systems Annual Program Review Meeting", "$NO_X$ and CO Emissions Models for Gas–Fired Lean–Premixed Combustion Turbines", A. Mellor, p. 111.

"Proceedings of the Advanced Turbine Systems Annual Program Review Meeting", "Methodologies for Active Mixing and Combustion Control", Uri Vandsburger, p. 123.
"Proceedings of the Advanced Turbine Systems Annual Program Review Meeting", "Combustion Modeling in Advanced Gas Turbine Systems", Paul O. Hedman, p. 157.
"Proceedings of the Advanced Turbine Systems Annual Program Review Meeting", "Manifold Methods for Methane Combustion", Stephen B. Pope, p. 181.
"Proceedings of the Advanced Turbine Systems Annual Program Review Meeting", "The Role of Reactant Unmixedness, Strain Rate, and Length Scale on Premixed Combustor Performance", Scott Samuelsen, p. 189.
"Proceedings of the Advanced Turbine Systems Annual Program Review Meeting", "Effect of Swirl and Momentum Distribution on Temperature Distribution in Premixed Flames", Ashwani K. Gupta, p. 211.
"Proceedings of the Advanced Turbine Systems Annual Program Review Meeting", "Combustion Instability Studies Application to Land–Based Gas Turbine Combustors", Robert J. Santoro, p. 233.
"Proceedings of the Advanced Turbine Systems Annual Program Review Meeting", "Active Control of Combustion Instabilities in Low $NO_x$ Turbines", Ben T. Zinn, p. 253.
"Proceedings of the Advanced Turbine Systems Annual Program Review Meeting", "Life Prediction of Advanced Materials for Gas Turbine Application," Sam Y. Zamrik, p. 265.
"Proceedings of the Advanced Turbine Systems Annual Program Review Meeting", "Combustion Chemical Vapor Deposited Coatings for Thermal Barrier Coating Systems", W. Brent Carter, p. 275.
"Proceedings of the Advanced Turbine Systems Annual Program Review Meeting", "Compatibility of Gas Turbine Materials with Steam Cooling", Vimal Desai, p. 291.
"Proceedings of the Advanced Turbine Systems Annual Program Review Meeting", "Bond Strength and Stress Measurements in Thermal Barrier Coatings", Maurice Gell, p. 315.
"Proceedings of the Advanced Turbine Systems Annual Program Review Meeting", "Advanced Multistage Turbine Blade Aerodynamics, Performance, Cooling and Heat Transfer", Sanford Fleeter, p. 335.
"Proceedings of the Advanced Turbine Systems Annual Program Review Meeting", "Flow Characteristics of an Intercooler System for Power Generating Gas Turbines", Ajay K. Agrawal, p. 357.
"Proceedings of the Advanced Turbine Systems Annual Program Review Meeting", "Improved Modeling Techniques for Turbomachinery Flow Fields", B. Lakshiminarayana, p. 371.
"Proceedings of the Advanced Turbine Systems Annual Program Review Meeting", "Development of an Advanced 3d & Viscous Aerodynamic Design Method for Turbomachine Components in Utility and Industrial Gas Turbine Applications", Thong Q. Dang, p. 393.
"Proceedings of the Advanced Turbine Systems Annual Program Review Meeting", "Advanced Turbine Cooling, Heat Transfer, and Aerodynamic Studies", Je–Chin Han, p. 407.
"Proceedings of the Advanced Turbine Systems Annual Program Review Meeting", "Heat Transfer in a Two–Pass Internally Ribbed Turbine Blade Coolant Channel with Vortex Generators", S. Acharya, p. 427.
"Proceedings of the Advanced Turbine Systems Annual Program Review Meeting", "Experimental and Computational Studies of Film Cooling with Compound Angle Injection", R. Goldstein, p. 447.
"Proceedings of the Advanced Turbine Systems Annual Program Review Meeting", "Study of Endwall Film Cooling with a Gap Leakage Using a Thermographic Phosphor Fluorescence Imaging System", Mingking K. Chyu, p. 461.
"Proceedings of the Advanced Turbine Systems Annual Program Review Meeting", "Steam as a Turbine Blade Coolant: External Side Heat Transfer", Abraham Engeda, p. 471.
"Proceedings of the Advanced Turbine Systems Annual Program Review Meeting", "Flow and Heat Transfer in Gas Turbine Disk Cavities Subject to Nonuniform External Pressure Field", Ramendra Roy, p. 483.
"Proceedings of the Advanced Turbine Systems Annual Program Review Meeting", "Closed–Loop Mist/Steam Cooling for Advanced Turbine Systems", Ting Wang, p. 499.
"Proceedings of the Advanced Turbine Systems Annual Program Review Meeting", "Heat Pipe Turbine Vane Cooling", Langston et al., p. 513.
"Proceedings of the Advanced Turbine Systems Annual Program Review Meeting", "EPRI's Combustion Turbine Program: Status and Future Directions", Arthur Cohn, p. 535.
"Proceedings of the Advanced Turbine Systems Annual Program Review Meeting", "ATS Materials Suport", Michael Karnitz, p. 553.
"Proceedings of the Advanced Turbine Systems Annual Program Review Meeting", "Land Based Turbine Casting Initiative", Boyd A. Meuller, p. 577.
"Proceedings of the Advanced Turbine Systems Annual Program Review Meeting", "Turbine Airfoil Manufacturing Technology", Charles S. Kortovich, p. 593.
"Proceedings of the Advanced Turbine Systems Annual Program Review Meeting", "Hot Corrosion Testing of TBS's", Norman Bornstein, p. 623.
"Proceedings of the Advanced Turbine Systems Annual Program Review Meeting", "Ceramic Stationary Gas Turbine", Mark van Roode, p. 633.
"Proceedings of the Advanced Turbine Systems Annual Program Review Meeting", "Western European Status of Ceramics for Gas Turbines", Tibor Bornemisza, p. 659.
"Proceedings of the Advanced Turbine Systems Annual Program Review Meeting", "Status of Ceramic Gas Turbines in Russia", Mark van Roode, p. 671.
"Status Report: The U.S. Department of of Energy's Advanced Turbine Systems Program", facsimile dated Nov. 7, 1996.
"Testing Program Results Validate GE's H Gas Turbine—High Efficiency, Low Cost of Eelctricity and Low Emissions", Roger Schonewald and Patrick Marolda.
"Testing Program Results Validate GE's Gas Turbine—High Efficiency, Low Cost of Eelctricity and Low Emissions", Slide Presentation—working draft.
"The Next Step In H . . . For Low Cost Per kW–Hour Power Generation", LP–1 PGE '98.
"Utility Advanced Turbine System (ATS) Technology Readiness Testing and Pre–Commercialization Demonstration", Document #486040, Oct. 1–Dec. 31, 1996, Publication Date, Jun. 1, 1997, Report Numbers: DOE/MC/31176–5628.

"Utility Advanced Turbine System (ATS) Technology Readiness Testing—Phase 3", Document #666274 Oct. 1, 1996–Sep. 30, 1997, Publication Date, Dec. 31, 1997, Report Numbers: DOE/MC/31176–10.
"Utility Advanced Turbine System (ATS) Technology Readiness Testing and Pre–Commercial Demonstration, Phase 3", Document #486029, Oct. 1–Dec. 31, 1995, Publication Date, May 1, 1997, Report Numbers: DOE/MC/31176 5340.
"Utility Advanced Turbine System (ATS) Technology Readiness Testing and Pre–Commercial Demonstration, Phase 3", Document #486132, Apr. 1–Jun. 30, 1976, Publication Date, Dec. 31, 1996, Report Numbers: DOE/MC/31176–5660.
"Utility Advanced Turbine System (ATS) Technology Readiness Testing and Pre–Commercial Demonstration—Phase 3", Document #587906, Jul. 1–Sep. 30, 1995, Publication Date, Dec. 31, 1995, Report Numbers: DOE/MC31176–5339.
"Utility Advanced Turbine System (ATS) Technology Readiness Testing and Pre–Commercial Demonstration," Document #666277, Apr. 1–Jun. 30, 1997, Publication Date, Dec. 31, 1997, Report Numbers: DOE/MC/31176–8.
"Utility Advanced Turbine System (ATS) Technology Readiness Testing and Pre–Commercialization Demonstration"Jan. 1–Mar. 31, 1996, DOE/MC/31176–5338.
"Utility Advanced Turbine System (ATS) Technology Readiness Testing: Phase 3R", Document #756552, Apr. 1–Jun. 30, 1999, Publication Date, Sep. 1, 1999, Report Numbers: DE–FC21–95MC31176–23.
"Utility Advanced Turbine System (ATS) Technology Readiness Testing.", Document #656823, Jan. 1–Mar. 31, 1998, Publication Date, Aug. 1, 1998, Report Numbers: DOE/MC/31176–17.
"Utility Advanced Turbine System (ATS) Technology Readiness Testing and Pre–Commercial Demonstration", Annual Technical Progress Report, Reporting Period: Jul. 1, 1995–Sep. 30, 1996.
"Utility Advanced Turbine System (ATS) Technology Readiness Testing", Phase 3R, Annual Technical Progress Report, Reporting Period: Oct. 1, 1997–Sep. 30, 1998.
"Utility Advanced Turbine System (ATS) Technology Readiness Testing", Document #750405, Oct. 1–Dec. 30, 1998, Publication Date: May, 1, 1999, Report Numbers: DE–FC21–95MC31176–20.
"Utility Advanced Turbine System (ATS) Technology Readiness Testing", Document #1348, Apr. 1–Jun. 29, 1998, Publication Date Oct. 29, 1998, Report Numbers DE–FC21–95MC31176–18.
"Utility Advanced Turbine System (ATS) Technology Readiness Testing—Phase 3", Annual Technical Progress Report, Reporting Period: Oct. 1, 1996–Sep. 30, 1997.
"Utility Advanced Turbine System (ATS) Technology Readiness Testing and Pre–Commercial Demonstration", Quarterly Report, Jan. 1–Mar. 31, 1997, Document #666275, Report Numbers: DOE/MC/31176–07.
"Proceedings of the 1997 Advanced Turbine Systems", Annual Program Review Meeting, Oct. 28–29, 1997.

* cited by examiner

APPARATUS AND METHODS FOR LOCALIZED COOLING OF GAS TURBINE NOZZLE WALLS

BACKGROUND OF THE INVENTION

The present invention relates to a gas turbine having a closed-circuit cooling system for one or more nozzle stages and particularly relates to a gas turbine having closed-circuit cooling with localized cooling of nozzle wall portions.

Gas turbine nozzles are often provided with open and/or closed-circuit cooling systems. In an open system, for example, an air-cooled nozzle, compressor discharge air is typically supplied to the nozzle vane and exhausted into the hot gas stream. Local air-film cooling is provided to afford improved cooling in localized areas on the airfoil as necessary and desirable. In closed-circuit nozzle cooling systems, a cooling medium, e.g., steam, typically flows from the outer band through various cavities in the vane, through the inner band and returns via return passages through the cavities in the vane and outer band to a steam outlet. The steam cools the nozzle walls by impingement cooling. An example of a closed circuit steam-cooled nozzle for a gas turbine is disclosed in U.S. Pat. No. 5,743,708, of common assignee herewith, the disclosure of which is incorporated herein by reference. That system also employs an open air cooling system for cooling the trailing edge of the vane.

In a closed circuit cooling system, however, it will be appreciated that toward the end of the closed cooling circuit, effective cooling of various surfaces is diminished. This is principally due to lower impingement pressure ratio and an increased cooling medium temperature along those local surfaces. For example, the walls of the cavities adjacent the cooling medium exhaust to the cooling medium outlet are difficult to effectively cool because they lie at the end of the cooling circuit. The cooling medium has gained significant heat pickup and the pressure ratio has been diminished sufficiently to render the localized impingement cooling less effective than desirable. As a consequence, the external wall temperature of the vane at such location is higher, leading to low-cycle fatigue life at such location. Accordingly, there is a need to effectively cool nozzle walls toward the end of the closed cooling circuit.

BRIEF SUMMARY OF THE INVENTION

In accordance with a preferred embodiment of the present invention, there is provided apparatus and methods for effectively cooling localized surfaces of the nozzle walls located adjacent the end of the closed cooling circuit to improve or increase low-cycle fatigue. To accomplish this, a portion of the cooling medium supplied at the beginning of the closed cooling circuit, i.e., a cooling medium portion at inlet conditions, is diverted to one or more secondary inserts within a cavity of the nozzle vane to cool the localized areas which are otherwise difficult to effectively cool at the end of the closed cooling circuit. Particularly, a secondary insert having impingement openings is located within a nozzle cavity adjacent a localized area, i.e., a hot spot requiring localized cooling and is supplied with cooling medium, e.g., steam which has not yet picked up heat from the vane or lost any pressure. The secondary insert uses the pressure drop across the entire cooling circuit to drive the cooling medium through its impingement openings for impingement-cooling of the localized area. This improves the low-cycle fatigue in the localized area being impingement cooled because cooler steam is applied at a significantly higher pressure ratio resulting in substantial increased cooling than otherwise using essentially spent cooling steam at the end of the closed cooling circuit. It will be appreciated that the main insert in the vane cavity and, as illustrated in the prior above-identified U.S. patent, receives the cooling medium, e.g., steam, from the inner band for flow through the insert for impingement-cooling of the vane walls adjacent the main insert. The secondary insert is disposed adjacent a localized hot spot in lieu of impingement-cooling by the main insert at such localized area to supply cooler steam at a higher pressure ratio and, hence, more effectively cool such localized area.

In accordance with a preferred embodiment hereof, there is provided, in a gas turbine nozzle having inner and outer bands and a vane extending therebetween having at least one cavity between side walls of the vane, an insert within the cavity and extending from the outer band and along and spaced from one of the side walls of the vane terminating within the cavity short of one-half the length of the vane, the insert defining a passage for receiving a cooling medium and having openings through a wall thereof for flowing the cooling medium therethrough to impingement-cool the one side wall of the vane and a passage for exhausting spent impingement cooling medium from the vane cavity.

In accordance with another preferred embodiment hereof, there is provided, in a gas turbine having inner and outer bands and a vane extending therebetween having at least one cavity between side walls of the vane, a first insert within the one cavity for receiving a cooling medium, the insert having lateral walls spaced from the side walls and a plurality of openings therethrough for flowing a cooling medium through the openings to impingement-cool the side walls of the vane, and a second insert within the one cavity and having a lateral wall in spaced opposition to one of the side walls with a plurality of openings therethrough for flowing a cooling medium therethrough to impingement-cool a portion of the one side wall.

In a further preferred embodiment hereof, there is provided, in a gas turbine having inner and outer bands, a vane extending therebetween having at least one cavity between side walls of the vane and a closed circuit cooling system for flowing a cooling medium through the vane to cool the vane, a method of cooling a localized area along the vane wall comprising the steps of flowing a first portion of the cooling medium through a first insert in the one cavity for impingement cooling a first portion of the side walls of the vane; flowing a second portion of the cooling medium through a second insert in the one cavity for cooling the localized area of the vane wall, and supplying the second portion of the cooling medium to the second insert at a lower temperature than the temperature of the first portion of the cooling medium supplied to the first insert.

In a still further preferred embodiment hereof, there is provided, in a gas turbine having inner and outer bands, a vane extending therebetween having at least one cavity between side walls of the vane and a closed circuit cooling system for flowing a cooling medium through the vane to cool the vane, a method of cooling a localized area along the vane wall comprising the steps of flowing a first portion of the cooling medium through a first insert in the one cavity for impingement cooling a first portion of the side walls of the vane; flowing a second portion of the cooling medium through a second insert in the one cavity for cooling the localized area of the vane wall, and including supplying the second portion of the cooling medium to the second insert at a higher pressure than the pressure of the first cooling medium portion supplied to the first insert.

DETAILED DESCRIPTION OF THE INVENTION

Figure 1:
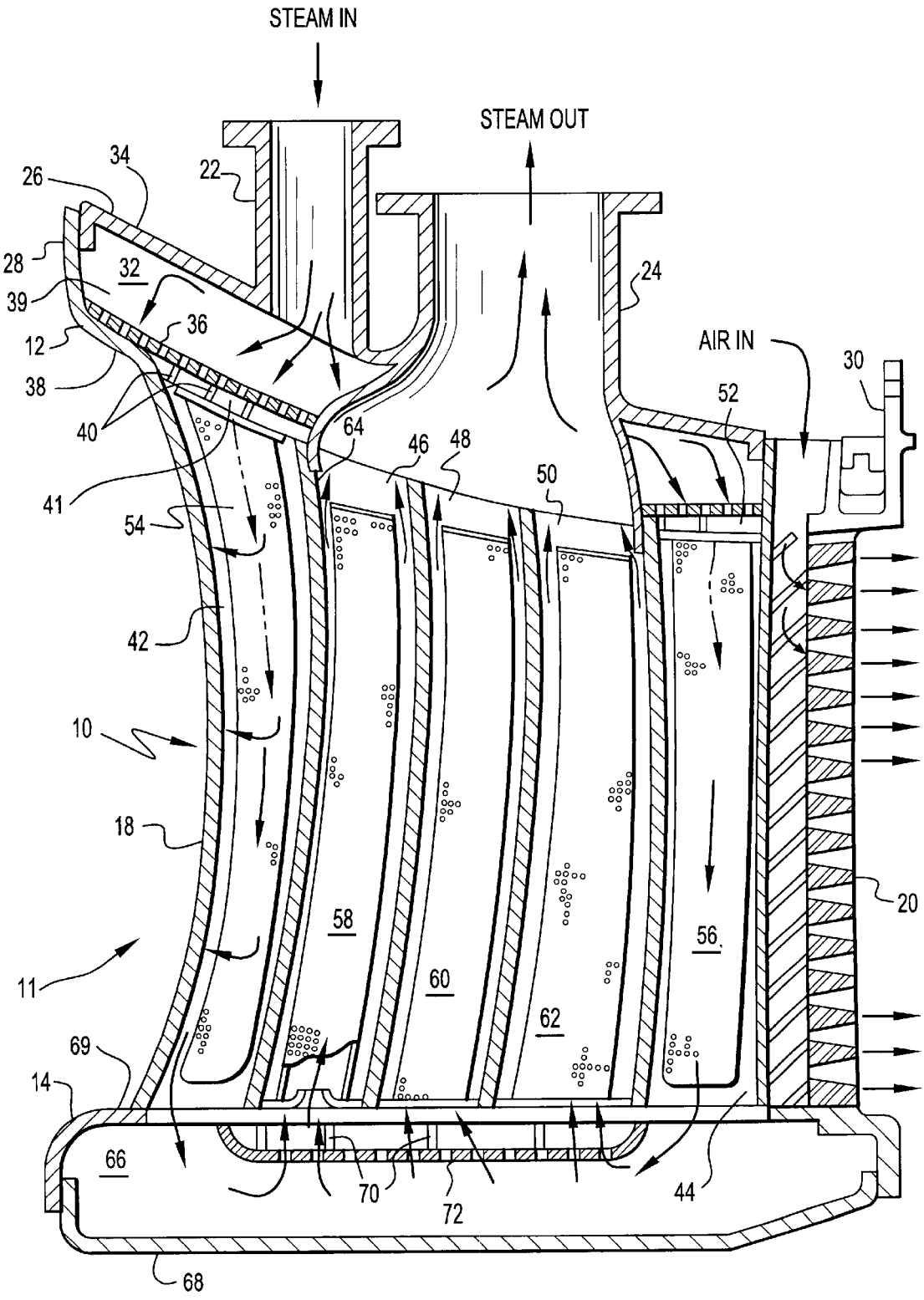
Fig. 1 (PRIOR ART)
FIG. 1 is an enlarged cross-section of a first-stage nozzle vane as in the prior art.
Figure 2:
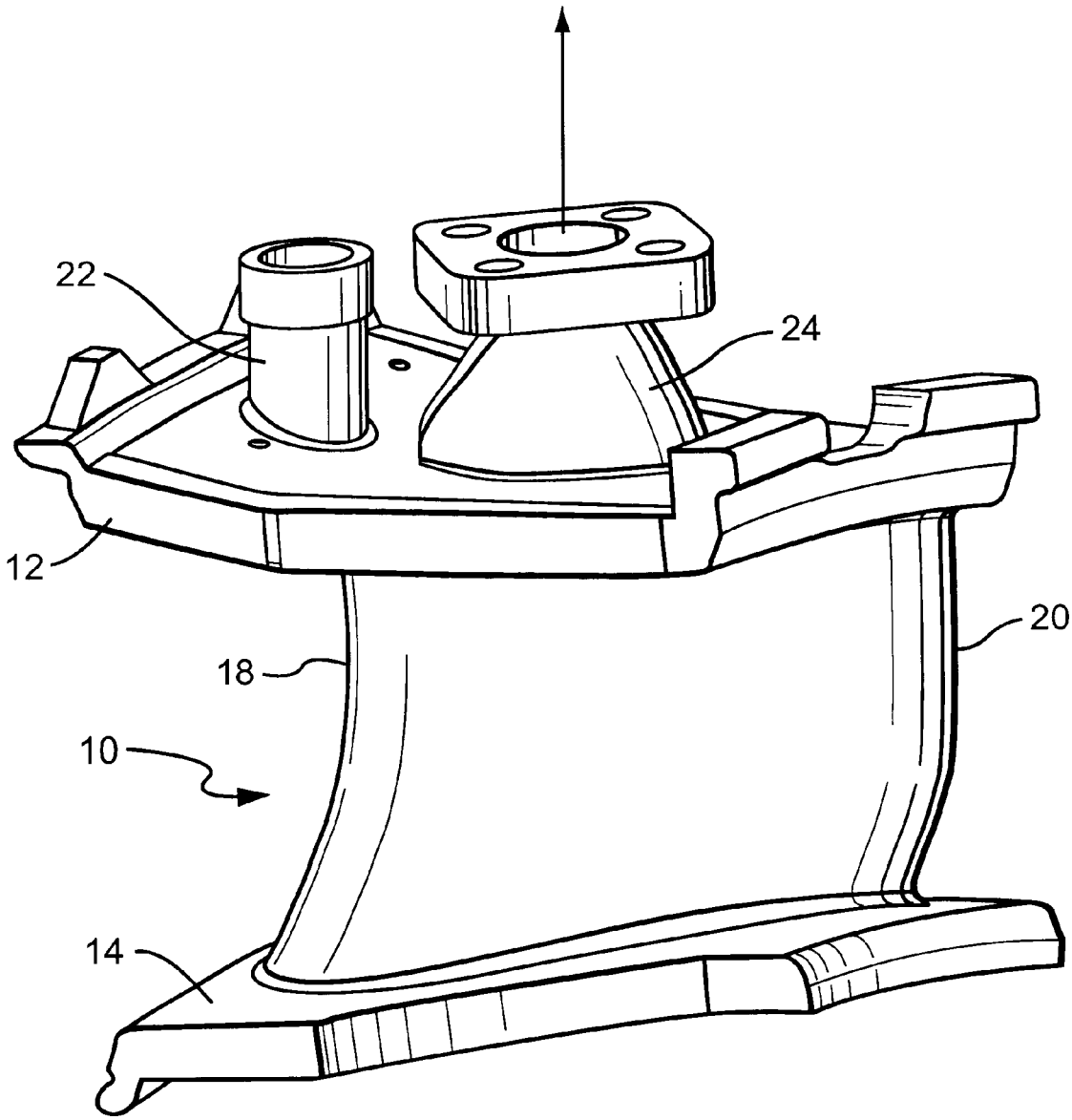
FIG. 2 is a perspective view of the nozzle segment of FIG. 3 after fabrication and assembly.

As discussed previously, the present invention relates in particular to closed cooling circuits for nozzle stages of a turbine, preferably a first-stage nozzle, reference being made to the previously identified patent for disclosure of various other aspects of the turbine, its construction and methods of operation. Referring now to FIG. 1, there is schematically illustrated in cross-section a vane 10 comprising one of a plurality of circumferentially arranged segments 11 of a first-stage nozzle for a gas turbine. It will be appreciated that the segments 11 are connected one to the other to form an annular array of segments defining the hot gas path through the first-stage nozzle of the turbine. Each segment includes radially spaced outer and inner bands 12 and 14, respectively, with one or more of the nozzle vanes 10 extending between the outer and inner bands. The segments are supported about the inner shell of the turbine (not shown) with adjoining segments being sealed one to the other. For purposes of this description, the vane 10 will be described as forming the sole vane of a segment, it being appreciated that each segment 11 may have two or more vanes. As illustrated, the vane 10 has a leading edge 18 and a trailing edge 20.

The prior art cooling circuit for the illustrated first-stage nozzle vane segment of FIG. 1 has a cooling steam inlet 22 to the outer band 12. A return steam outlet 24 also lies in communication with the nozzle segment. The outer band 12 includes an outer side railing 26, a leading railing 28, and a trailing railing 30 defining a plenum 32 with an upper cover 34 and an impingement plate 36 disposed in the outer band 12. (The terms outwardly and inwardly or outer and inner refer to a generally radial direction). Disposed between the impingement plate 36 and the inner wall 38 of outer band 12 are a plurality of structural ribs 40 extending between the side walls 26, forward railing 28 and trailing railing 30. The impingement plate 36 overlies the ribs 40 throughout the full extent of the plenum 32. Consequently, steam entering through inlet 22 into plenum 32 passes through the openings in the impingement plate 36 for impingement cooling of the outer wall 38 of the outer band 12, the outer band thus having first and second chambers 39 and 41 on opposite sides of the impingement plate.

The first-stage nozzle vane 10 also has a plurality of cavities, for example, the leading edge cavity 42, an aft cavity 44, three intermediate return cavities 46, 48 and 50, and a trailing edge cavity 52. These cavities are defined by transversely extending ribs extending between opposite side walls of the vane. One or more additional cavities or fewer cavities may be provided.

Leading edge cavity 42 and aft cavity 44 each have an insert, 54 and 56 respectively, while each of the intermediate cavities 46, 48 and 50 have similar inserts 58, 60 and 62, respectively, all such inserts being in the general form of hollow sleeves. The inserts may be shaped to correspond to the shape of the particular cavity in which the insert is to be provided. The side walls of the sleeves are provided with a plurality of impingement cooling openings, along portions of the insert which lie in opposition to the walls of the vane to be impingement cooled. For example, in the leading edge cavity 42, the forward edge of the insert 54 is arcuate and the side walls would generally correspond in shape to the side walls of the cavity 42, all such walls of the insert having impingement openings. The back side of the sleeve or insert 54 in opposition to the rib 64 separating cavity 42 from cavity 46, however, does not have impingement openings. In the aft cavity 44, on the other hand, the side walls, only, of the insert sleeve 56 have impingement openings; the forward and aft walls of insert sleeve 56 being of a solid non-perforated material.

It will be appreciated that the inserts received in cavities 42, 44, 46, 48, and 50 are spaced from the walls of the cavities to enable a cooling medium, e.g., steam, to flow through the impingement openings to impact against the interior wall surfaces of the cavities, thus cooling the wall surfaces. As apparent from the ensuing description, inserts 54 and 56 are closed at their radially inner ends while inserts 58, 60 and 62 are closed at their radially outer ends.

As illustrated in FIG. 1, the post-impingement cooling steam cooling the outer wall 38 flows into the open outer ends of inserts 54 and 56 for impingement-cooling of the vane walls in registration with the impingement openings in the inserts along the length of the vane. The steam then flows into a plenum 66 in the inner band 14 which is closed by an inner cover plate 68. Structural strengthening ribs 70 are integrally cast with the inner wall 69 of band 14. Radially inwardly of the ribs 70 is an impingement plate 72. As a consequence, it will be appreciated that the spent impingement cooling steam flowing from cavities 42 and 44 flows into the plenum 66 and through the impingement openings of impingement plate 72 for impingement cooling of the inner wall 69. The spent cooling steam flows by direction of the ribs 70 towards openings in ribs 70 (not shown in detail) for return flow through the cavities 46, 48, and 50 to the steam outlet 24. Particularly, inserts 58, 60 and 62 are disposed in the cavities 46, 48, and 50 in spaced relation from the side walls and ribs defining the respective cavities. The impingement openings of inserts 58, 60 and 62 lie along the opposite sides thereof in registration with the vane walls. Thus, the spent cooling steam flows through the open inner ends of the inserts 58, 60 and 62 and through the impingement openings for impingement cooling the adjacent side walls of the vane. The spent cooling steam then flows out the outlet 24 for return to, e.g., the steam supply.

The air cooling circuit of the trailing edge cavity of the combined steam and air cooling circuits of the vane illustrated in FIG. 1 generally corresponds to the cooling circuit disclosed in the '708 patent. Therefore, a detailed discussion thereof is omitted.

As noted above, in a closed-circuit nozzle designs, localized areas of the vane, particularly toward the end of the closed cooling circuit, may not be as effectively cooled as desired. As in the prior art of FIG. 1, for example, a localized area adjacent the forward convex side wall of the vane is exposed to impingement-cooling using spent cooling steam adjacent the exit of the closed-circuit cooling system. The temperature differential of the spent cooling steam vis-a-vis the surfaces to be cooled is minimum and the pressure ratio driving the spent cooling steam through the impingement openings is likewise minimal. The present invention, however, affords improved localized cooling of surfaces at the end of the closed cooling system.

Figure 3:
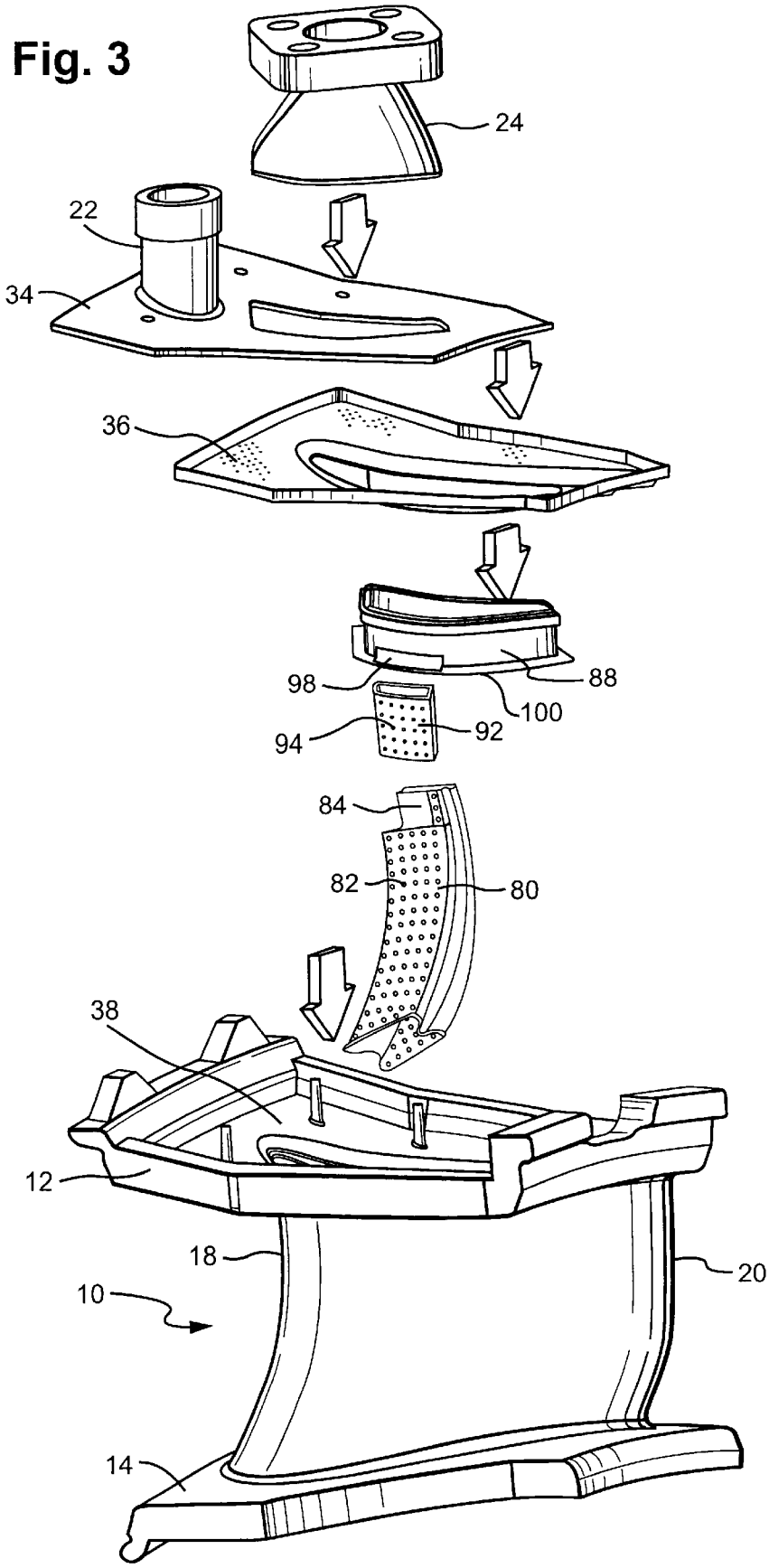
FIG. 3 is an exploded perspective view of a nozzle segment with one vane illustrating an assemblage of main and secondary inserts, an exit chimney, impingement plate, cover, and an exit port to the outer band portion of the segment in accordance with the present invention.
Figure 4:
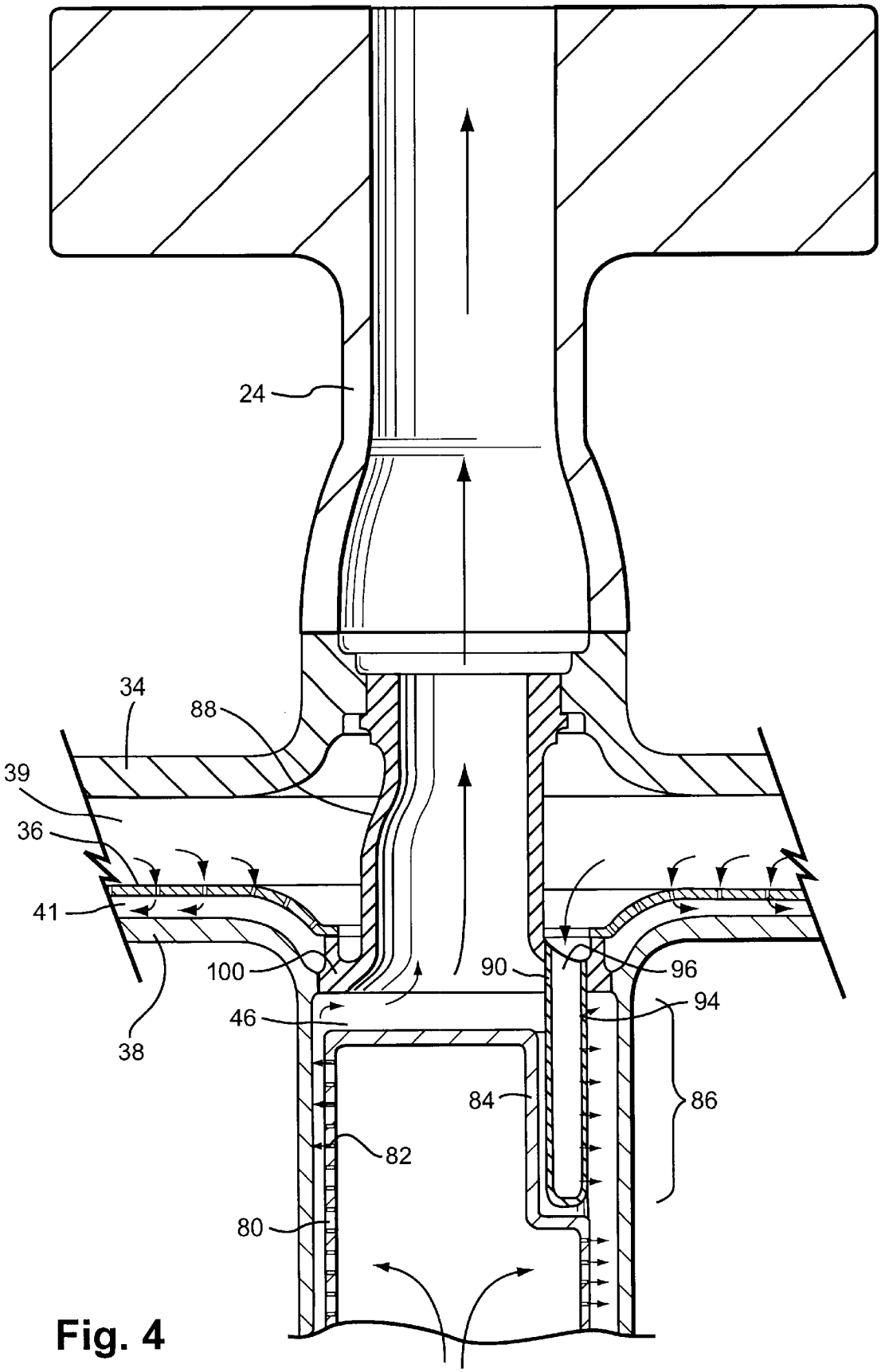
FIG. 4 is an enlarged fragmentary cross-sectional view illustrating the main and secondary inserts in the second cavity of the vane together with the exit chimney and portions of the outer band cooling system.
Figure 5:
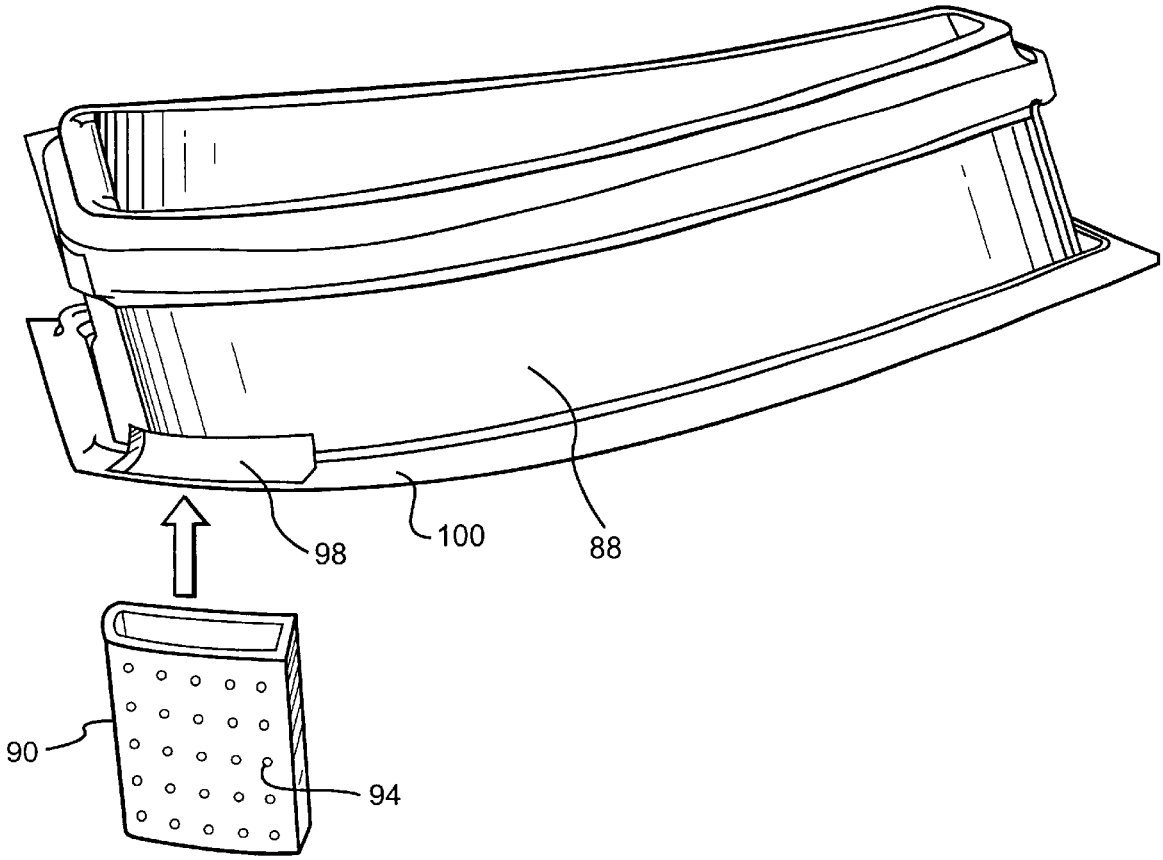
FIG. 5 is an exploded perspective view illustrating the nozzle exit chimney and secondary insert.
Figure 6:
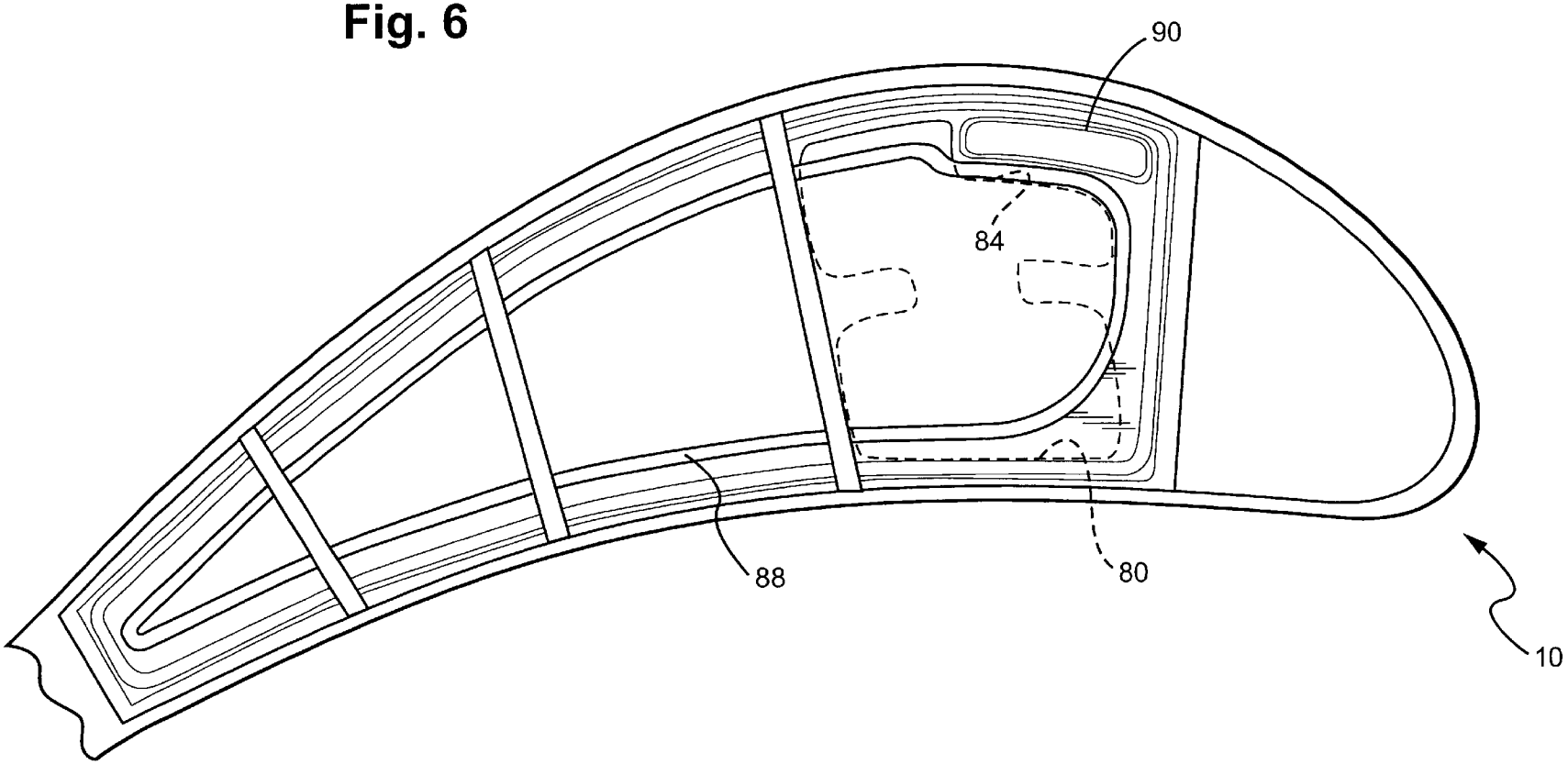
FIG. 6 is a schematic view through the exit chimney of the vane illustrating the location of the main and secondary inserts.

Referring now to FIGS. 3 and 4, there is illustrated an improved closed cooling circuit, particularly for the second cavity 46, although the improved cooling circuit may be used for other cavities, cavity 46 being a representative example. As illustrated, the insert in cavity 46 is modified. Such modified insert constitutes a first or main insert in FIGS. 3, 4 and 6. Insert 80 similarly as insert 58 has opposite side walls with impingement openings 82 therethrough for impingement-cooling of the side walls of the vane adjacent the insert 80. Adjacent the outer band and on the convex side of the vane, however, the insert is stepped inwardly and has a wall 84 which does not contain impingement openings. As a consequence, and as best illustrated in FIG. 4, the insert 80, which is closed at its outer end, provides impingement-cooling of the opposite walls of the vane except the wall portion adjacent the localized area 86, which does not receive impingement-cooling from the cooling steam flowing in insert 80. As illustrated in FIG. 4, the impingement-cooling steam directed against the side walls of the vane exhausts from the cavity 46 through an exit chimney 88 and into the steam outlet 24.

To effectively cool the localized area 86 on the convex side of the vane 10, a secondary or second insert 90 is provided. This secondary insert 90 essentially constitutes a mini-insert in the form of a rectilinear pocket 92 having impingement openings 94 through one side face thereof. The secondary insert 90 extends only a very limited distance into vane 10, e.g., less than one-half the length of main insert 80 and terminates at its inner end short of the inner end of the main insert 80. The pocket 92 is essentially closed except for a steam inlet passage 96 opening adjacent its outer end. The secondary insert 90 is secured in a slot 98 (FIG. 3) formed in the flange 100 of the exit chimney 88. Preferably, the outer end of the secondary insert 90 is brazed to the flange 100. As illustrated in FIG. 4, the inlet passage 96 to the secondary insert 90 lies in communication with the outer or first chamber 39 of the outer band plenum 32. Consequently, cooling medium, e.g., steam, at inlet conditions is supplied the main insert 80 and the secondary insert 90 from a common source, i.e., plenum 32, the cooling medium supplied insert 90 being used to impingement-cool the localized area 86 on the convex side of the vane. Only a very minor portion of the inlet steam is supplied to the secondary insert 90 while the bulk of the inlet steam is supplied to the cooling circuit previously described with respect to FIG. 1. The spent impingement-cooling medium exiting the impingement openings 94 of the secondary insert 90 combines with the spent cooling medium exiting the openings 82 of the main insert 80 and combined therewith for flow through the exit chimney 88 and outlet 24. As a consequence, enhanced localized cooling is provided to an area of the vane otherwise ineffectively cooled, whereby improved low-cycle fatigue is obtained.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In a gas turbine nozzle having inner and outer bands and a vane extending therebetween having at least one cavity between side walls of the vane, an insert within said cavity and extending from said outer band and along and spaced from one of the side walls of said vane terminating within said cavity short of one-half the length of the vane, said insert defining a passage for receiving a cooling medium and having openings through a wall thereof for flowing the cooling medium therethrough to impingement-cool said one side wall of said vane and a passage for exhausting spent impingement cooling medium from the vane cavity.

2. Apparatus according to claim 1, wherein said outer band includes a plenum for receiving the cooling medium, said insert lying in communication with said plenum.

3. Apparatus according to claim 2, wherein said outer band includes an impingement plate in said plenum spaced from a wall of said outer band forming part of a hot gas path through the turbine, said impingement plate dividing the plenum into first and second chambers on opposite sides thereof and having a plurality of openings therethrough for flowing the cooling medium from said first chamber through said openings into said second chamber for impingement cooling said outer band wall, said insert lying in communication with said first chamber for receiving a portion of the cooling medium from said first chamber.

4. Apparatus according to claim 1, wherein said one side wall is a convex side wall of the vane.

5. In a gas turbine having inner and outer bands and a vane extending therebetween having at least one cavity between side walls of the vane, a first insert within said one cavity for receiving a cooling medium, said insert having lateral walls spaced from said side walls and a plurality of openings therethrough for flowing a cooling medium through said openings to impingement-cool the side walls of the vane, and a second insert within said one cavity and having a lateral wall in spaced opposition to one of said side walls with a plurality of openings therethrough for flowing a cooling medium therethrough to impingement-cool a portion of said one side wall, said second insert extending from adjacent said outer band into said vane a distance short of an inner end of said first insert.

6. Apparatus according to claim 5, wherein said first insert extends substantially the full length of said vane.

7. Apparatus according to claim 5 wherein said outer band includes a plenum for receiving the cooling medium, said second insert lying in communication with said plenum.

8. Apparatus according to claim 5 wherein said vane has convex and concave side walls, said second insert being located adjacent the convex side wall, with said plurality of openings through said lateral wall disposed to flow the cooling medium to impingement-cool a portion of said convex side wall.

9. Apparatus according to claim 5 wherein said second insert lies laterally between said one side wall and said first insert.

10. Apparatus according to claim 5 wherein said lateral wall of said second insert and said one wall lie closer to said outer band than said inner band.

11. In a gas turbine having inner and outer bands, a vane extending therebetween having at least one cavity between side walls of the vane and a closed circuit cooling system for flowing a cooling medium through said vane to cool the vane, a method of cooling a localized area along the vane wall comprising the steps of:

flowing a first portion of the cooling medium through a first insert in the one cavity for impingement cooling a first portion of the side walls of the vane;

flowing a second portion of the cooling medium through a second insert in said one cavity for cooling the localized area of the vane wall, and supplying the second portion of the cooling medium to said second insert at a lower temperature than the temperature of the first portion of the cooling medium supplied to said first insert.

12. A method according to claim 11, including supplying the first and second portions of the cooling medium from a common source, passing the first portion of the cooling medium from said common source through said vane in one direction for cooling the vane and subsequently passing the first portion of the cooling medium into said first insert through said vane in a generally opposite direction to cool said vane.

13. A method according to claim 12, including passing the second portion of the cooling medium from said common source directly into said second insert.

14. A method according to claim 11, including providing a plenum for the cooling medium in said outer band, passing the first portion of the cooling medium from the plenum in a generally radial inward direction through said vane for cooling the vane and into a plenum in said inner band, subsequently passing the first portion of the cooling medium from the plenum in the inner band into said first insert for flow in a generally radial outward direction to cool said vane and passing the second portion of the cooling medium from the plenum in said outer band into said second insert.

15. A method according to claim 14, including combining spent first and second portions of the cooling medium for flow to a spent cooling medium outlet in said outer band.

16. A method according to claim 11, including forming a plurality of cavities in said vane, providing another insert in another of said cavities, providing a plenum for the cooling medium in said outer band, passing the first portion of the cooling medium from the plenum in a generally radial inward direction through said another insert for impingement cooling of another portion of the side walls of said vane and into a plenum in said inner band, subsequently passing the first portion of the cooling medium from the plenum in the inner band into said first insert for flow in a generally radial outward direction for impingement cooling of said side walls of said vane, passing the second portion of the cooling medium from the plenum in said outer band into said second insert, and combining spent first and second portions of the cooling medium for flow to a spent cooling medium outlet in said outer band.

17. A method according to claim 11, including supplying the second portion of the cooling medium to said second insert at a higher pressure than the pressure of the first cooling medium portion supplied to said first insert.

18. In a gas turbine having inner and outer bands, a vane extending therebetween having at least one cavity between side walls of the vane and a closed circuit cooling system for flowing a cooling medium through said vane to cool the vane, a method of cooling a localized area along the vane wall comprising the steps of:

flowing a first portion of the cooling medium through a first insert in the one cavity for impingement cooling a first portion of the side walls of the vane;

flowing a second portion of the cooling medium through a second insert in said one cavity for cooling the localized area of the vane wall; and supplying the second portion of the cooling medium to said second insert at a higher pressure than the pressure of the first cooling medium portion supplied to said first insert.

19. A method according to claim 18, including supplying the first and second portions of the cooling medium from a common source, passing the first portion of the cooling medium from said common source through said vane in one direction for cooling the vane and subsequently passing the first portion of the cooling medium into said first insert through said vane in a generally opposite direction to cool said vane.

20. A method according to claim 19, including passing the second portion of the cooling medium from said common source directly into said second insert.

21. A method according to claim 18, including providing a plenum for the cooling medium in said outer band, passing the first portion of the cooling medium from the plenum in a generally radial inward direction through said vane for cooling the vane and into a plenum in said inner band, subsequently passing the first portion of the cooling medium from the plenum in the inner band into said first insert for flow in a generally radial outward direction to cool said vane and passing the second portion of the cooling medium from the plenum in said outer band into said second insert.

22. A method according to claim 21, including combining spent first and second portions of the cooling medium for flow to a spent cooling medium outlet in said outer band.

23. A method according to claim 18, including forming a plurality of cavities in said vane, providing another insert in another of said cavities, providing a plenum for the cooling medium in said outer band, passing the first portion of the cooling medium from the plenum in a generally radial inward direction through said another insert for impingement cooling of another portion of the side walls of said vane and into a plenum in said inner band, subsequently passing the first portion of the cooling medium from the plenum in the inner band into said first insert for flow in a generally radial outward direction for impingement cooling of said side walls of said vane, passing the second portion of the cooling medium from the plenum in said outer band into said second insert, and combining spent first and second portions of the cooling medium for flow to a spent cooling medium outlet in said outer band.

24. In a gas turbine having inner and outer bands and a vane extending therebetween having at least one cavity between side walls of the vane, a first insert within said one cavity for receiving a cooling medium, said insert having lateral walls spaced from said side walls and a plurality of openings therethrough for flowing a cooling medium through said openings to impingement-cool the side walls of the vane, and a second insert within said one cavity and having a lateral wall in spaced opposition to one of said side walls with a plurality of openings therethrough for flowing a cooling medium therethrough to impingement-cool a portion of said one side wall, said second insert extending a distance in said vane less than one-half the length of said vane between said inner and outer bands.

25. In a gas turbine having inner and outer bands and a vane extending therebetween having at least one cavity between side walls of the vane, a first insert within said one cavity for receiving a cooling medium, said insert having lateral walls spaced from said side walls and a plurality of openings therethrough for flowing a cooling medium through said openings to impingement-cool the side walls of the vane, and a second insert within said one cavity and having a lateral wall in spaced opposition to one of said side walls with a plurality of openings therethrough for flowing a cooling medium therethrough to impingement-cool a portion of said one side wall, said outer band including a plenum for receiving the cooling medium, said second insert lying in communication with said plenum, said outer band including an impingement plate in said plenum spaced from a wall of said outer band forming part of a hot gas path through the turbine, said impingement plate dividing the plenum into first and second chambers on opposite sides thereof and having a plurality of openings therethrough for flowing the cooling medium from said first chamber through said openings into said second chamber to impingement-cool said outer band wall, said second insert lying in communication with said first chamber for receiving a portion of the cooling medium from said first chamber.

26. In a gas turbine having a plurality of circumferentially arranged segments of a nozzle stage, each segment comprising inner and outer bands and a vane extending therebetween having a plurality of cavities between side walls of the vane, a closed-circuit cooling system for cooling the side walls of the vane including a plenum in said outer band for receiving a cooling medium for flow through one of said cavities into a plenum in said inner band and return flow through another of said plurality of cavities in said vane and through said outer band, the cooling system including a first insert within said another of said cavities for receiving the cooling medium from said inner band plenum, said first insert having lateral walls spaced from said side walls of the vane and a plurality of openings therethrough for flowing a cooling medium received from the inner band plenum through said openings to impingement-cool the side walls of the vane, and a second insert within said another cavity and having a lateral wall in spaced opposition to one of said side walls of said another cavity, said second insert lying in communication with said outer band plenum for receiving cooling medium therefrom and flowing the cooling medium through a plurality of openings through the lateral wall of said second insert to impingement-cool a portion of said one side wall.

27. Apparatus according to claim 26 wherein said vane has convex and concave side walls, said second insert being located adjacent the convex side wall, with said plurality of openings through said lateral wall disposed to flow the cooling medium to impingement-cool a portion of said convex side wall.

28. Apparatus according to claim 26 wherein said lateral wall of said second insert and said one side wall lie closer to said outer band than said inner band.

* * * * *

UNITED STATES PATENT AND TRADEMARK OFFICE

CERTIFICATE OF CORRECTION

PATENT NO. : 6,543,993 B1
APPLICATION NO. : 09/749616
DATED : April 8, 2003
INVENTOR(S) : Burdgick et al.

It is certified that error appears in the above-identified patent and that said Letters Patent is hereby corrected as shown below:

In Column 1, immediately below the title, insert:

--The Government of the United States of America has rights in this invention pursuant to Contract No. DE-FC21-95MC31176 awarded by the U. S. Department of Energy.--

Signed and Sealed this

Twentieth Day of February, 2007

JON W. DUDAS
*Director of the United States Patent and Trademark Office*